US005725896A

United States Patent [19]

Banks

[11] Patent Number: 5,725,896

[45] Date of Patent: Mar. 10, 1998

[54] CARBONATED BEVERAGE PACKAGE

[75] Inventor: Anthony J. Banks, Weatheroak, Great Britain

[73] Assignee: CPB Innovative Technology Limited, Birmingham, England

[21] Appl. No.: 500,978

[22] PCT Filed: Jan. 21, 1994

[86] PCT No.: PCT/GB94/00127

§ 371 Date: Feb. 14, 1996

§ 102(e) Date: Feb. 14, 1996

[87] PCT Pub. No.: WO94/16966

PCT Pub. Date: Aug. 4, 1994

[30] Foreign Application Priority Data

Jan. 25, 1993 [GB] United Kingdom ..... 9301440
Feb. 16, 1993 [GB] United Kingdom ..... 9303055

[51] Int. Cl.[6] ..... B65B 31/00; B65B 17/00

[52] U.S. Cl. ..... 426/112; 426/115; 426/124; 426/397; 426/131; 426/394; 426/477; 99/323.1; 99/323.2; 220/581; 220/585; 215/6; 53/120

[58] Field of Search ..... 426/112, 115, 426/124, 316, 131, 394, 397, 477; 99/323.1, 323.2; 206/221, 222; 220/502, 581, 585; 215/6; 53/420

[56] References Cited

U.S. PATENT DOCUMENTS

| | | | |
|---|---|---|---|
| 2,073,273 | 3/1937 | Wetstein | 99/323.2 |
| 2,533,806 | 12/1950 | Holzapfel | 206/221 |
| 2,631,521 | 3/1953 | Atkins, Jr. | 99/275 |
| 3,039,644 | 6/1962 | Lefcort | 220/501 |
| 3,578,210 | 5/1971 | Pitrolffy-Szabo | 222/52 |
| 4,423,670 | 1/1984 | Tenison | 99/275 |
| 4,458,584 | 7/1984 | Annese et al. | 99/323.1 |
| 4,995,533 | 2/1991 | Vandonnick | 222/54 |
| 5,460,846 | 10/1995 | Stumphauzer et al. | 426/477 |
| 5,549,037 | 8/1996 | Stumphauzer et al. | 99/323.1 |

FOREIGN PATENT DOCUMENTS 9202434 2/1992 WIPO .

*Primary Examiner*—Donald E. Czaja
*Assistant Examiner*—Curtis E. Sherrer
*Attorney, Agent, or Firm*—Reinhart, Boerner, Van Deuren, Norris & Rieselbach, s.c.

[57] ABSTRACT

A beverage container assembly (28) comprising a container body defining a beverage chamber for containing a beverage, and a gas reservoir unit (1) adapted to be housed substantially within the container body (22). The gas reservoir unit (1) is adapted to be charged with a gas under super-atmospheric pressure whilst the reservoir unit (1) is outside of the container (22), and to retain the gas prior to insertion of the unit into the container body. A gas reservoir unit containing one or more chambers is also described.

32 Claims, 15 Drawing Sheets

CARBONATED BEVERAGE PACKAGE

Figure 1:
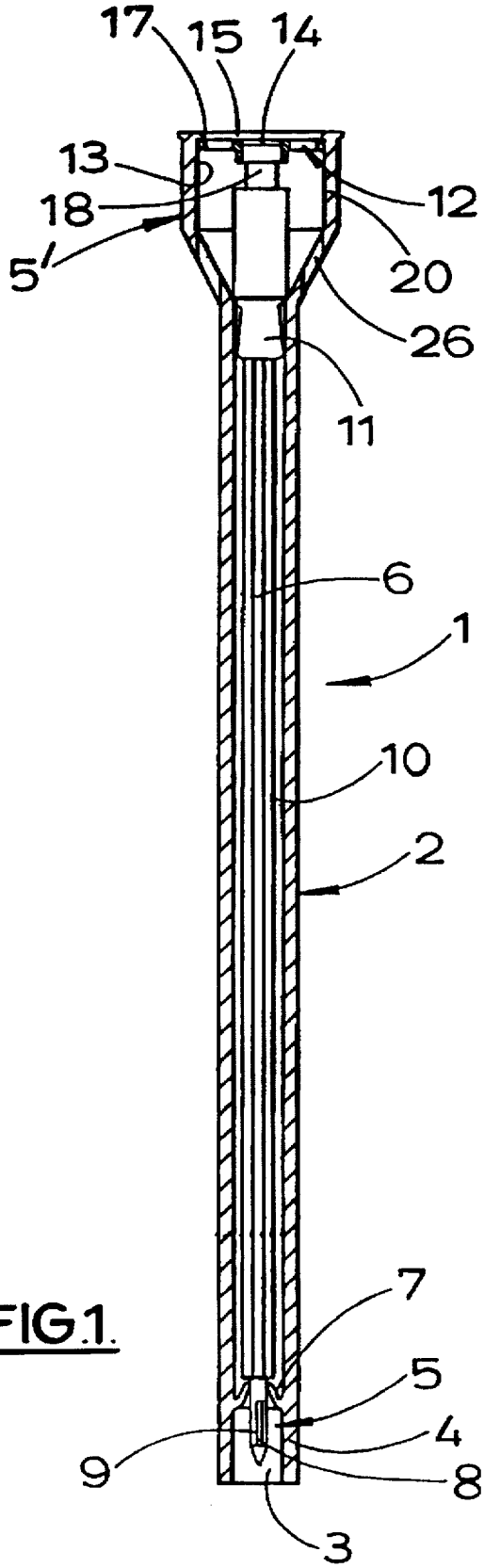

This invention relates to containers and packages and particularly, but not exclusively, beverage containers and packages, and to means for charging beverage in a container with gas.

The container may be large, such as a beer keg, or small, such as a bottle or beverage can.

Beer kegs containing beer are delivered to a public house or other establishment in a sealed condition, and pipe work and an external pressurised gas source are connected to the keg for dispensing beer. The pressurised gas source is usually a nitrogen cylinder.

Precautions need to be taken to ensure that the beer in the keg does not become contaminated in any way when the gas supply is connected to the keg, but the measures taken are not always adequate.

One application of the present invention is to the pressurization of beer kegs, but other applications of the invention relate to the gasification of beverages, which may be alcoholic or non-alcoholic, in bottles and cans:

In relation to cans of beer, in particular stout, various proposals have been made, for example in specifications no. GB 1,266,351, EP 0,227,213A, WD91/07326, WO92/02434, WO91/13006 and WO92/00897, for providing a gas reservoir within a beverage can, the reservoir emitting gas under pressure into the beer when the can is broached. The gas reservoirs have either a permanently open gas outlet, as in EP 0,227,213A for example, of restricted dimensions, or the outlet is arranged to open when the reservoir is subjected externally to atmospheric pressure, as in FIGS. 32 to 40 of WO91/07326 for example.

Various aspects of the present invention provide a gas reservoir unit which is capable of being charged with gas, such as nitrogen, under super-atmospheric pressure prior to incorporation of the reservoir unit into the container.

According to one aspect of the present invention a beverage container assembly comprises a container body defining an enclosed beverage chamber for containing a beverage, a gas reservoir unit adapted to be housed substantially within the container body, the gas reservoir unit being adapted to be charged with a gas under super-atmospheric pressure whilst the reservoir unit is outside of the container, and to retain the gas prior to insertion of the unit into the container body, the unit comprising a gas outlet means which is adapted to be opened by a valve control means during or subsequent to insertion of the unit into the container body, to allow gas in the reservoir to issue into beverage in the beverage chamber.

When the container body is a beer keg, the gas reservoir unit can be a gas cylinder assembly which is charged with nitrogen, or other suitable gas, and the gas reservoir unit can be assembled to the keg at the brewery, whereby the brewery supplies kegs of beer containing the gas reservoir unit. The operative at the drinks establishment is thereby relieved of the need to attach a gas cylinder to the keg.

The gas reservoir may or may not be removed from the keg for recharging of the reservoir on refilling of the keg with beer.

The gas reservoir unit is provided with an outlet controlled by a valve means which may be arranged to be operable by the operative by actuating means accessible from the exterior of the keg.

According to a second aspect of the invention a beer keg, or equivalent large-volume fluid container, is provided with a gas reservoir unit housed substantially within the keg, actuating means being provided which is accessible from the exterior of the keg and is operative to allow gas to flow from the reservoir unit into beer contained in the keg.

Particularly, but not exclusively, in applications of the invention to smaller containers, such as bottles or cans of the kind which are sold individually or in packs through off-licences and other retail outlets for example, the gas reservoir unit preferably comprises a gas outlet controlled by an outlet valve means, and a valve retainer is adapted to retain the outlet valve means closed after charging of the reservoir unit and prior to insertion of the reservoir unit into the container, and valve retainer disabling means arranged to disable the valve retainer during sealing of the container.

Preferably the arrangement is such that the assembly of a sealing member to the container is arranged to disable a valve control means.

The sealing member may be a plug or a cap which displaces the valve retainer during securing of the plug or cap to the container, displacement of the valve retainer moving the retainer from a position in which the valve retainer holds the valve means in a closed condition, to a position in which the valve retainer permits opening of the valve means.

The gas reservoir unit is preferably elongate, the outlet from the reservoir chamber being positioned substantially at one end of the unit, with the valve control means extending to substantially the other end of the unit. When such a unit is used in a can or bottle, said one end is positioned at a substantial depth of the beverage such that when gas is emitted through the outlet into the beverage the gas has to rise through a significant depth of the beverage, said other end being positioned at or adjacent the top of the can or in the neck of the bottle.

The valve control means is preferably a rod which carries an outlet valve member adjacent said one end of the unit and co-operates with said valve retainer adjacent said other end of the unit.

The valve retainer is preferably a spider which in an axially outer position relative to the body of the reservoir unit is arranged to hold the rod axially relative to the unit body, but in a displaced, axially inner position relative to the unit body permits axial movement of the rod to enable the valve to open.

The valve retainer is preferably disabled by a valve retainer disabling means in the form of an axially projecting annulus on the sealing member, which annulus displaces the spider from said outer position to said inner position on securing the sealing member to the container.

The outer end portion of the unit body is preferably in the configuration of a basket, to enable beverage to flow out of the container aperture that is sealed by the sealing member. The apertures in the basket can be dimensioned to restrict the flow such that if the opened container is knocked over, the spillage is significantly less than if the basket were not in place.

A third aspect of the invention is directed at a problem which arises with carbonated beverages, particularly in bottles which hold several glass-fulls of beverage. As is well known, the dissolved gas is largely lost during pouring of the first glass of beverage and during storage of a partially full bottle.

According to a third aspect of the invention we provide a gas reservoir unit adapted to be housed substantially within a beverage container, the unit containing two or more gas chambers for containing gas under super-atmospheric pressure, and valve means adapted to connect the gas chambers in turn to the interior of the beverage container, to enable, in use, gas contained in the chambers to be emitted into beverage in the container.

This arrangement enables an additional charge of gas to be emitted into the beverage subsequent to the initial opening of the container to pour one or more drinks.

The gas chambers are conveniently annular chambers defined between a multi-stepped plunger and the wall of a multi-stepped bore of the gas reservoir body in which the plunger is axially movable.

Each annular chamber is sealed adjacent one axial end thereof, that end towards the smallest end of the stepped bore, by an annular sealing means acting between the plunger and the bore wall, the arrangement being such that on a predetermined axial displacement of the plunger in the bore from an initial plunger position in which the chambers are sealed from one another the sealing means at said one end of the chamber becomes inoperative, or by-passed, thereby allowing fluid communication between said annular chamber and the respectively adjacent, smaller diameter portion of the bore, and the relative axial dispositions of the sealing means is arranged such that as the plunger is displaced progressively in the direction towards the larger diameter end of the multi-stepped bores, the respective annular sealing means become inoperative or are by-passed in turn, to connect the respective chamber with an outlet leading from the smallest end of the stepped bore.

The annular sealing means are preferably respective annular sealing lips depending integrally from the bore wall, and the plunger is preferably provided with a respective frusto-conical section between respectively adjacent plunger portions of larger and smaller diameter, the sealing means being bypassed when the plunger has moved sufficiently to bring the respective frusto-conical portion substantially into register with the respective sealing lip.

The axial movement of the plunger is preferably controlled by a finger-operable actuating means which is calibrated to enable the gas in the chambers to be released one at a time from the reservoir by operation of the actuating means.

The actuating means is preferably a rotary member which can be turned or indexed by the user.

According to a fourth aspect of the invention, a beverage bottle assembly comprises a bottle and a gas reservoir unit adapted to be housed substantially within the bottle, the gas reservoir unit comprising a reservoir securing means which is adapted to be secured to the bottle neck to retain the gas reservoir unit in position in the bottle.

The securing means can help to prevent the gas reservoir unit from being ejected under pressure from the bottle.

The reservoir securing means is preferably in the form of a plug which is received as a snug or force fit in the bottle neck, the plug being provided with a pouring aperture to permit beverage to be poured from the bottle.

Preferably the plug is in the form of a basket.

According to a fifth aspect of the invention, we provide an assembly for closing an opening in a container for housing a beverage, the assembly comprising a gas reservoir unit and a container sealing member attached thereto, the unit being of the form defined according to any of said previous aspects of the invention.

Such an assembly may be provided with a gas reservoir unit having any of said features as set forth above.

Various embodiments of the invention will now be described, by way of example only, with reference to the accompanying drawings in which:

FIG. 1 is a vertical cross-section of a charged gas reservoir unit with the outlet valve held closed by the valve retainer and prior to downward displacement of the valve retainer.

Figure 2:
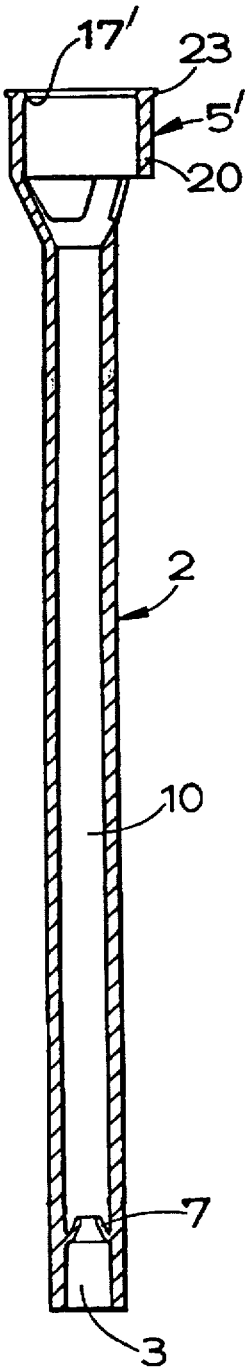
Figure 3:
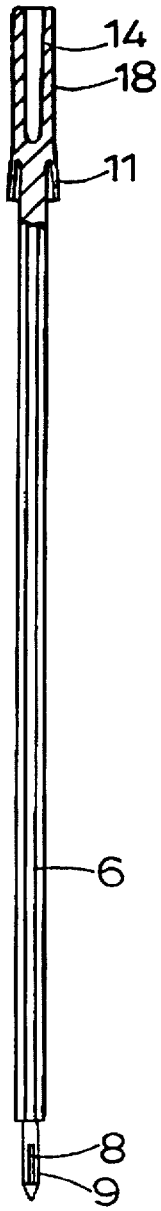
Figure 4:
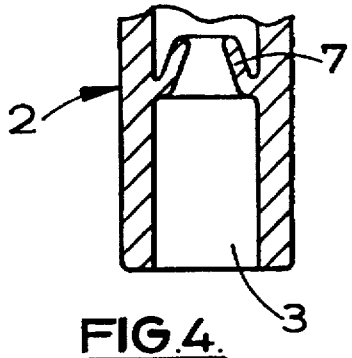
Figure 5:
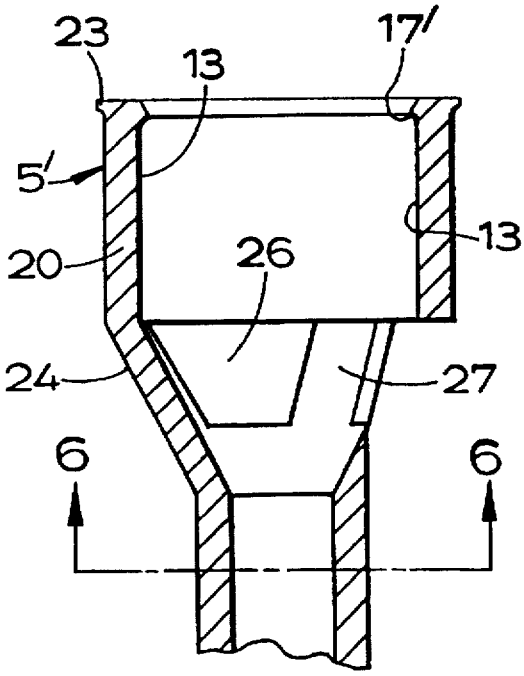
Figure 6:
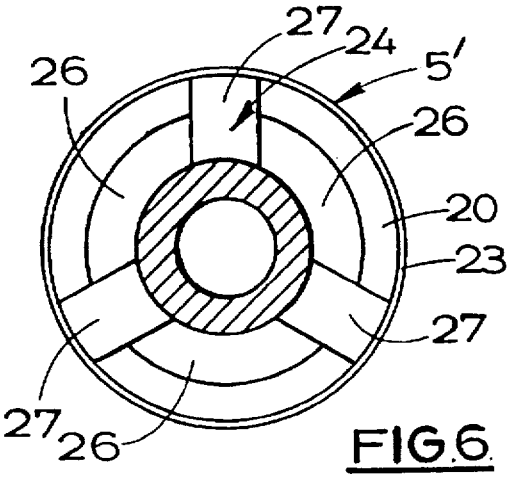
Figure 7:
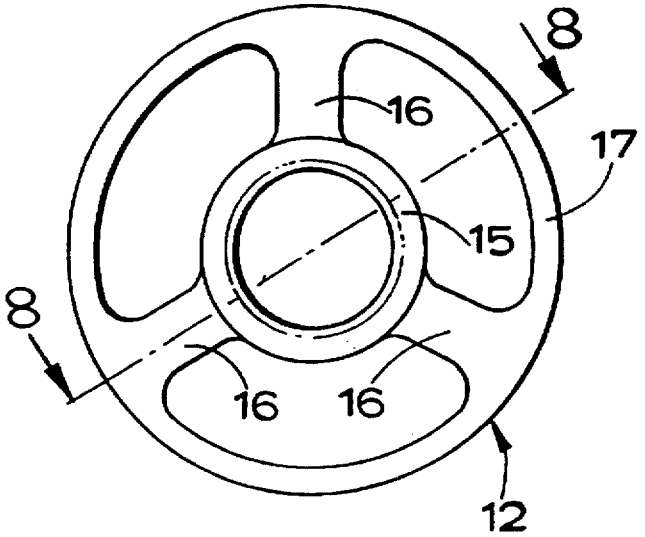
Figure 8:
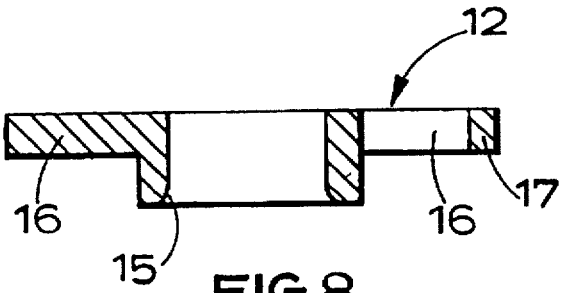
Figure 10:
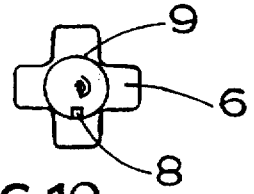
Figure 9:
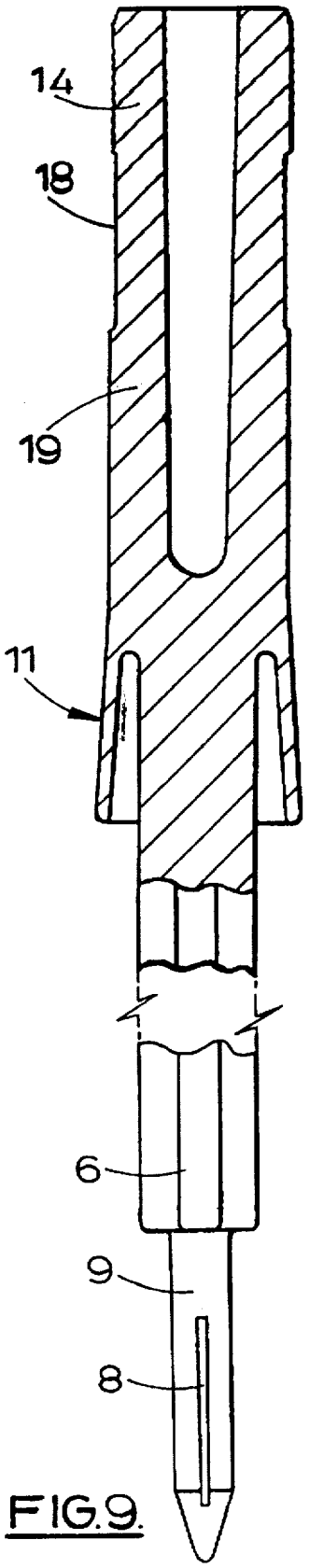
Figure 11:
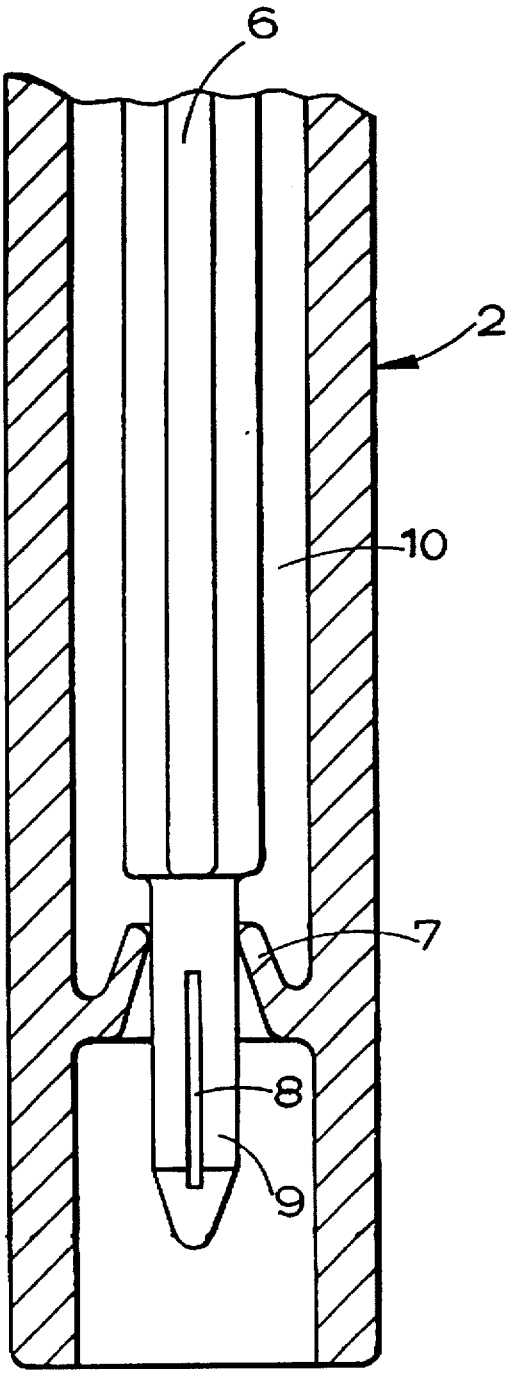
Figure 12:
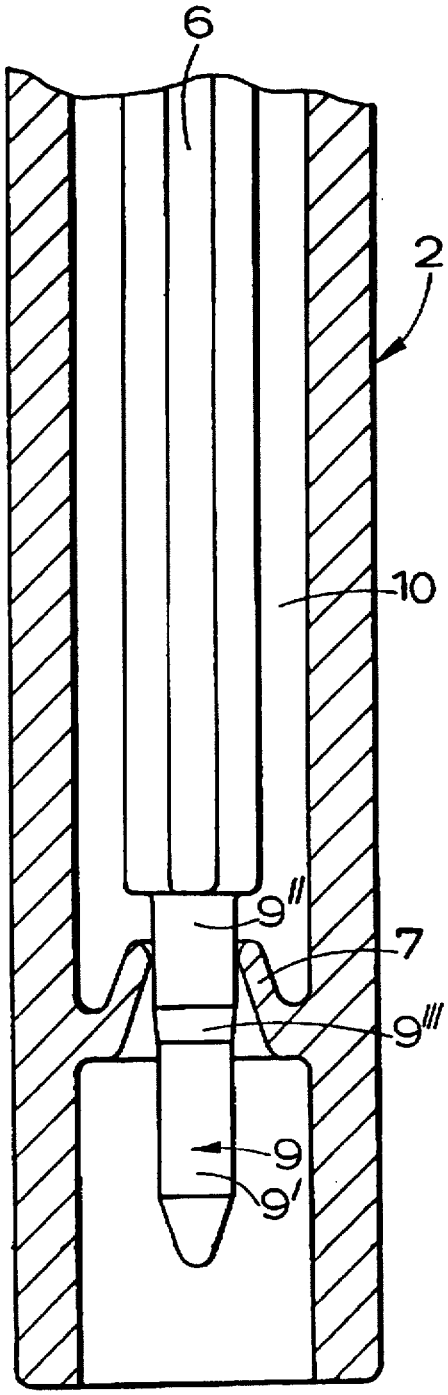
Figure 13:
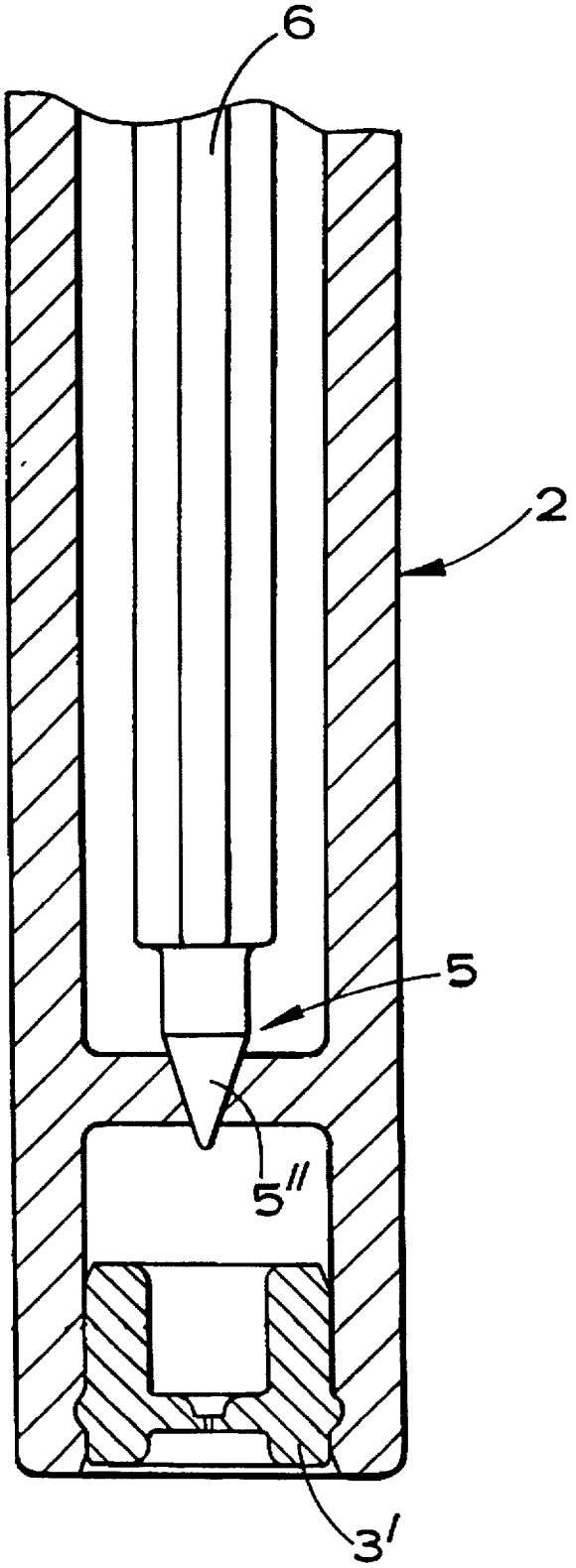
Figure 14:
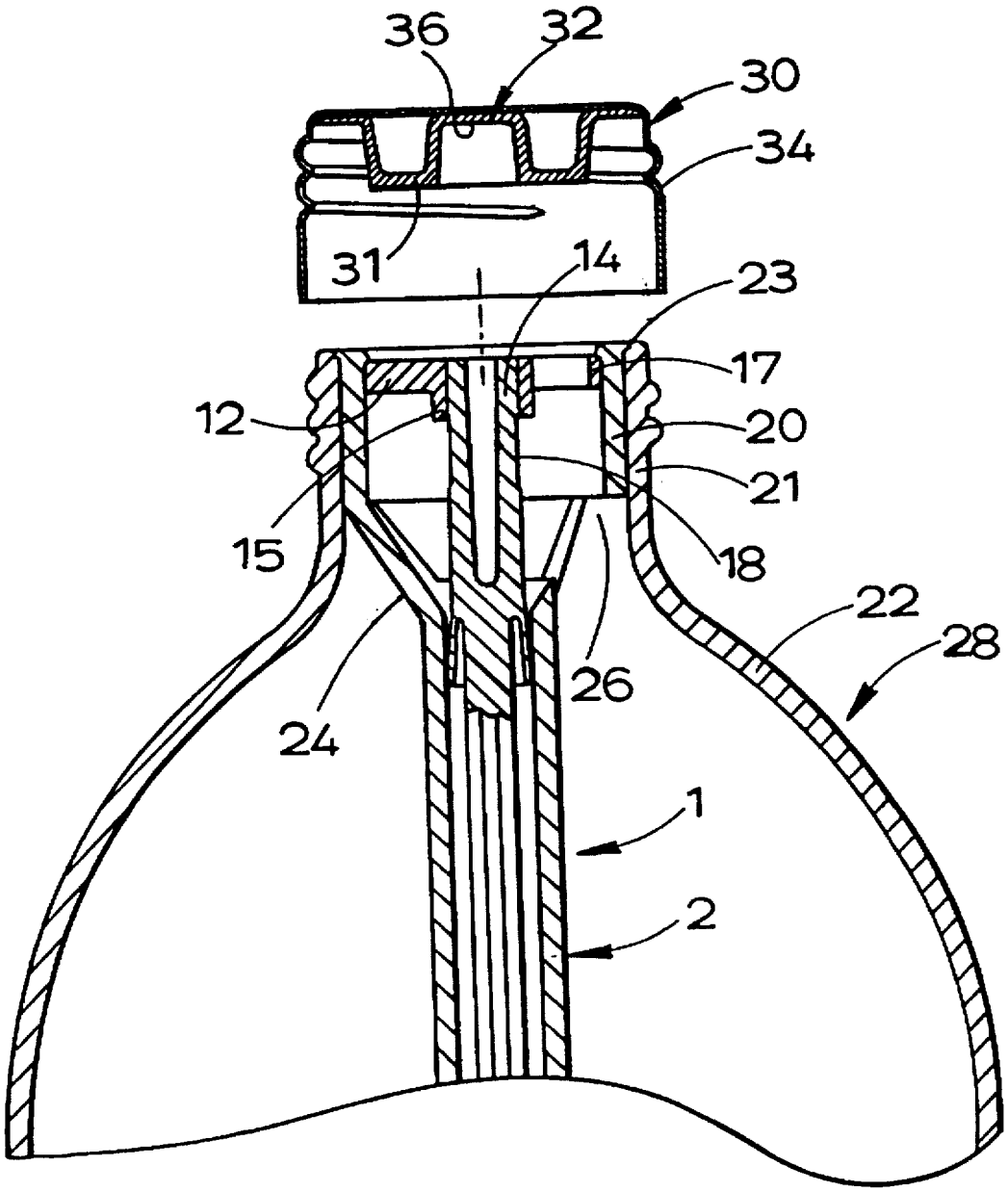
Figure 15:
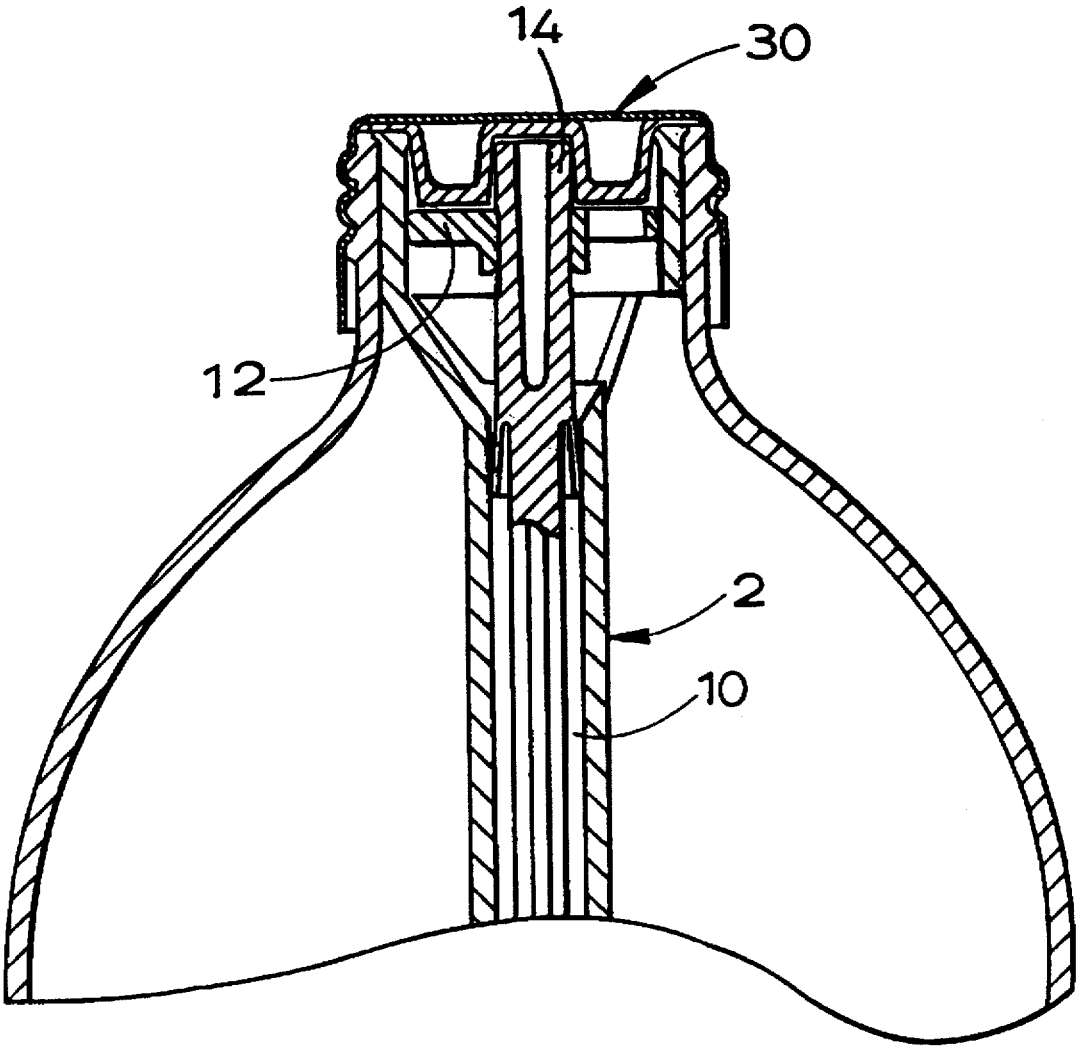
Figure 16:
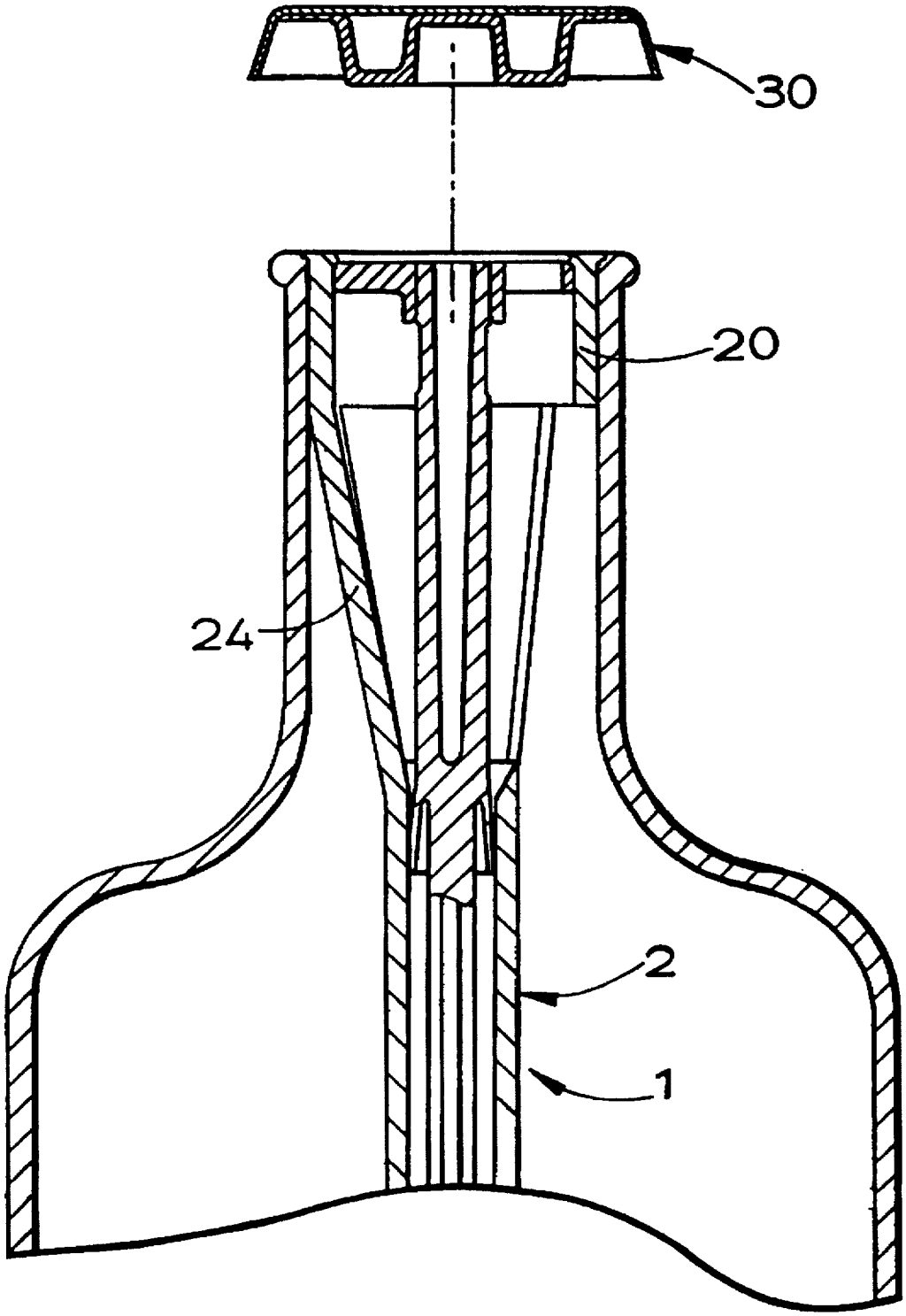
Figure 17:
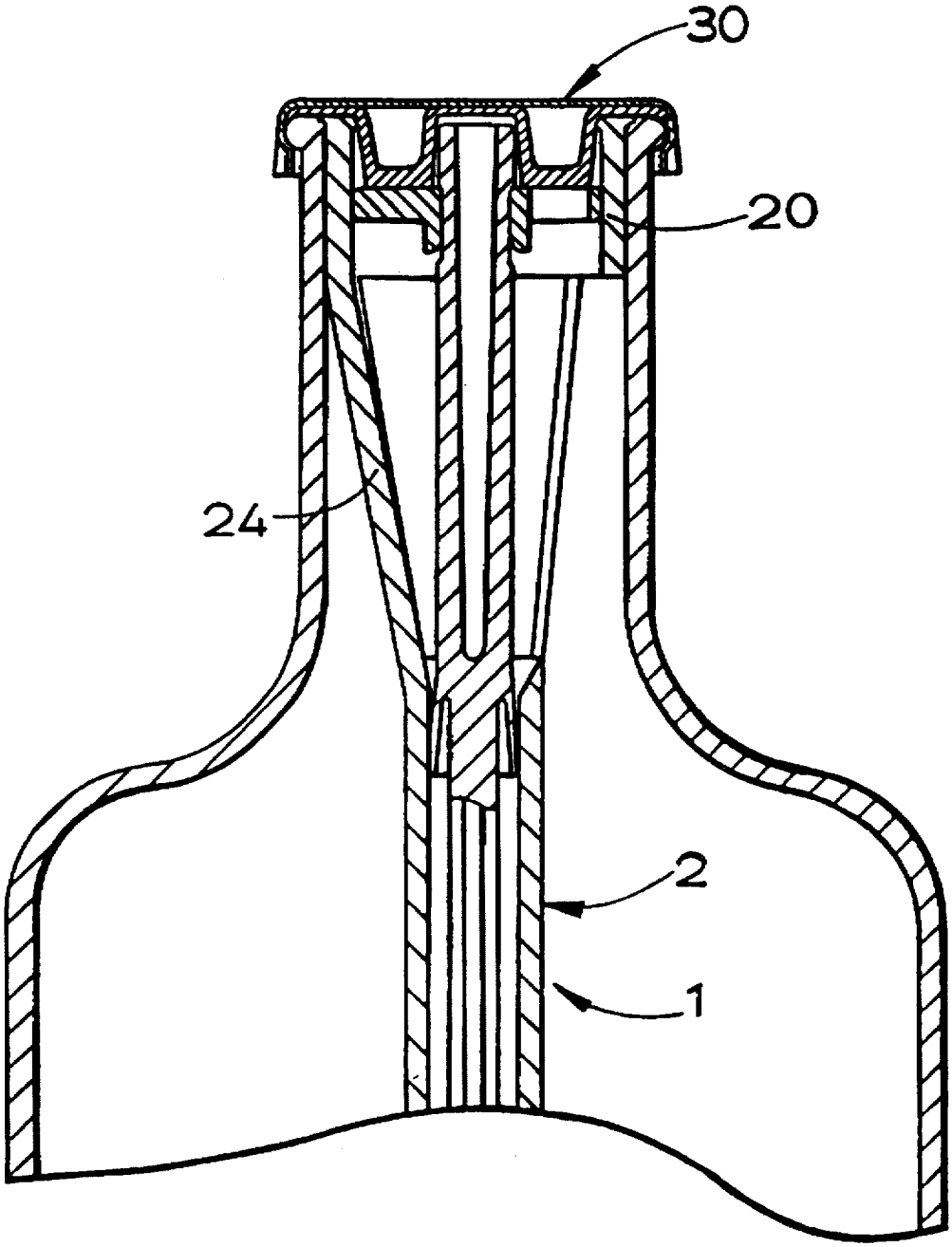
Figure 18:
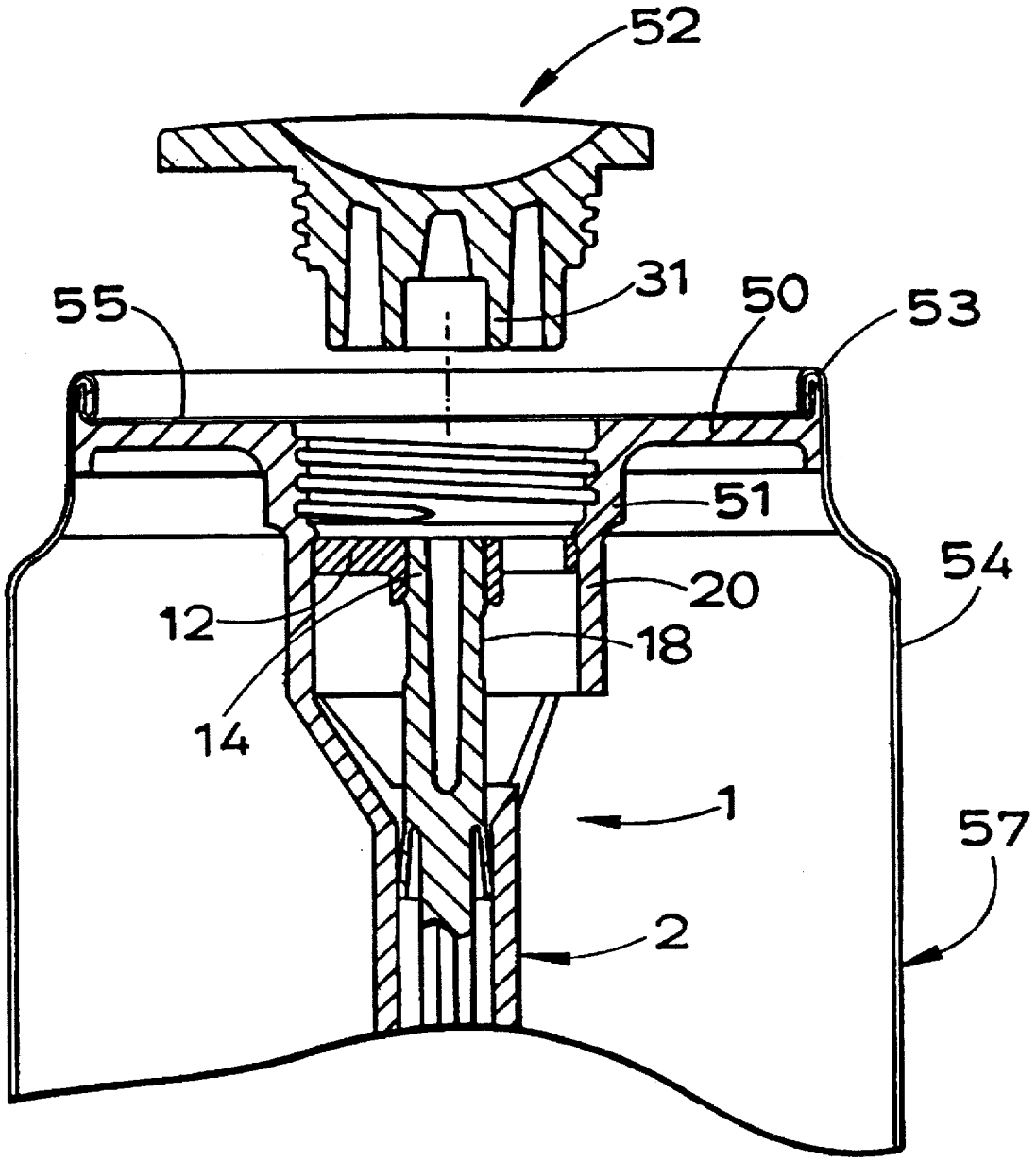
Figure 19:
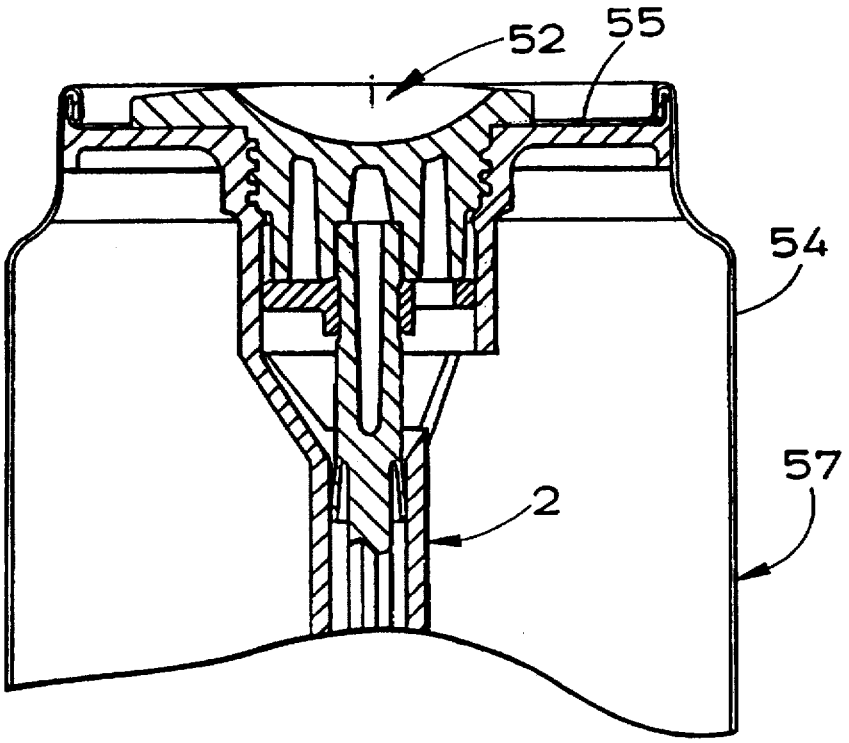
Figure 20:
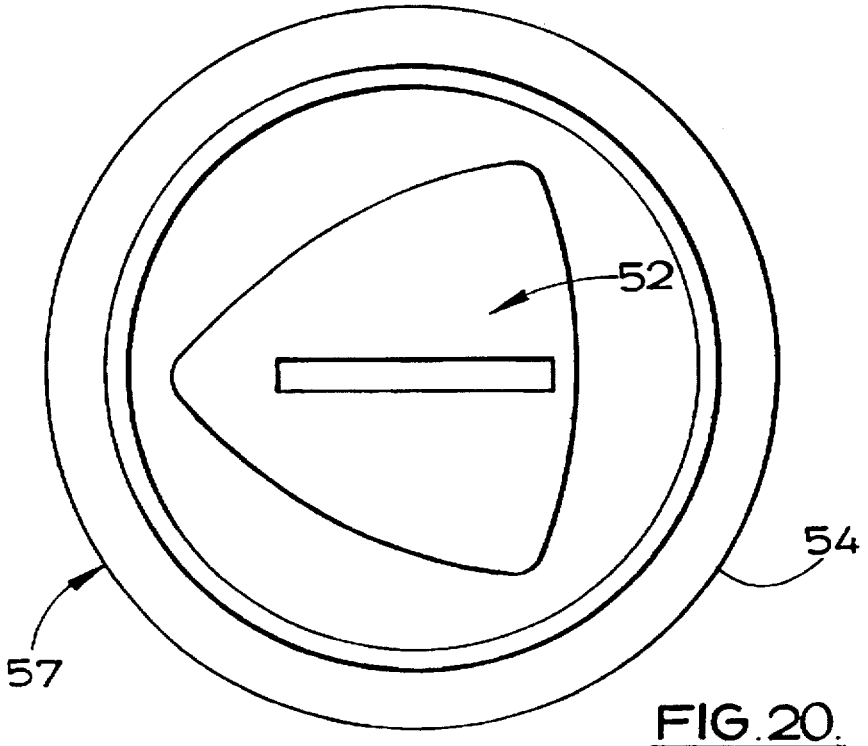
Figure 21:
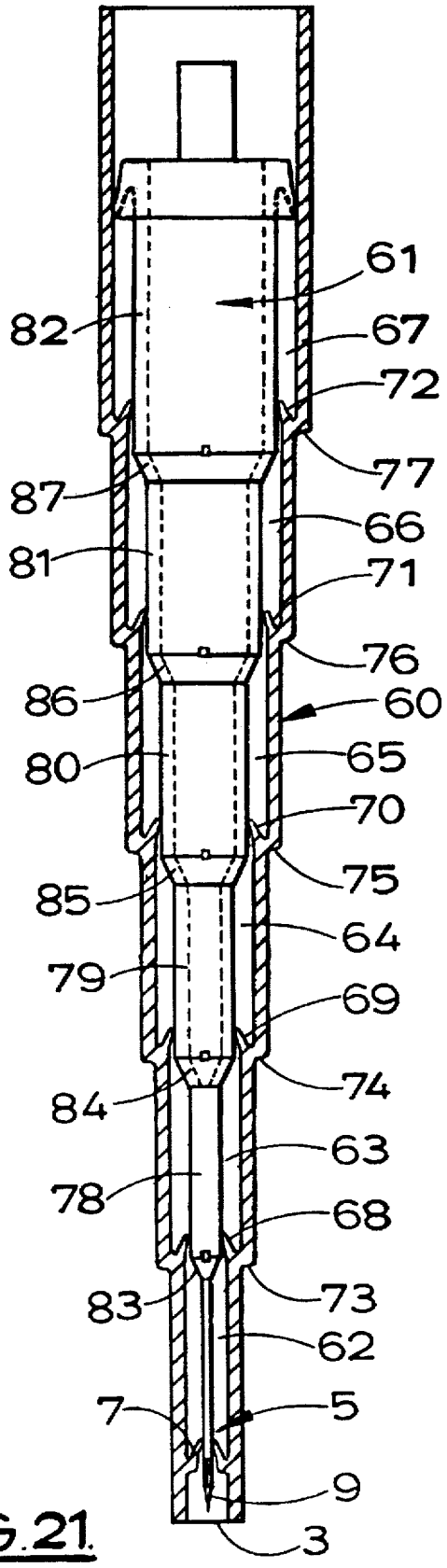
Figure 22:
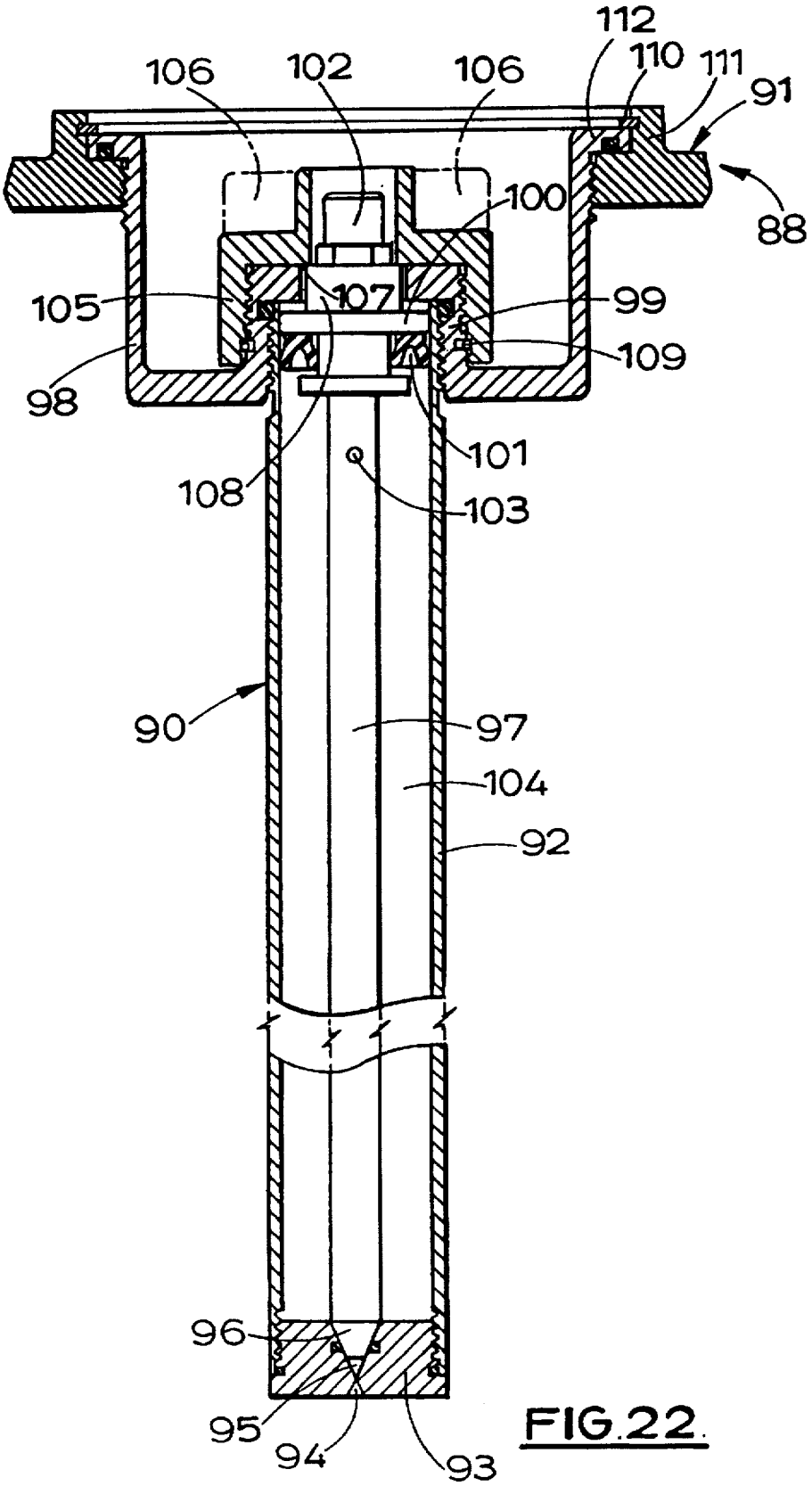
Figure 23:
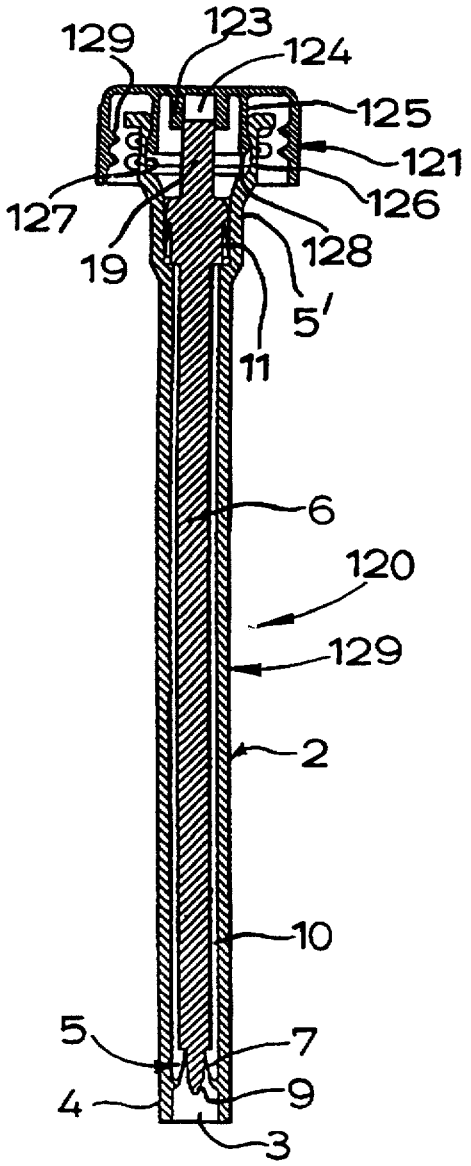
Figure 24:
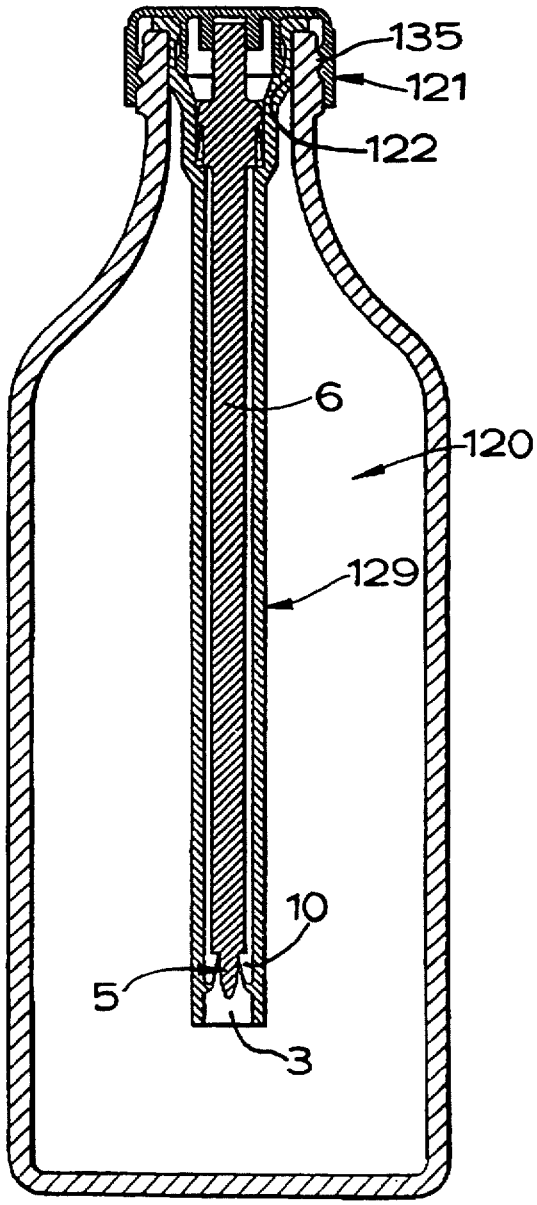
Figure 25:
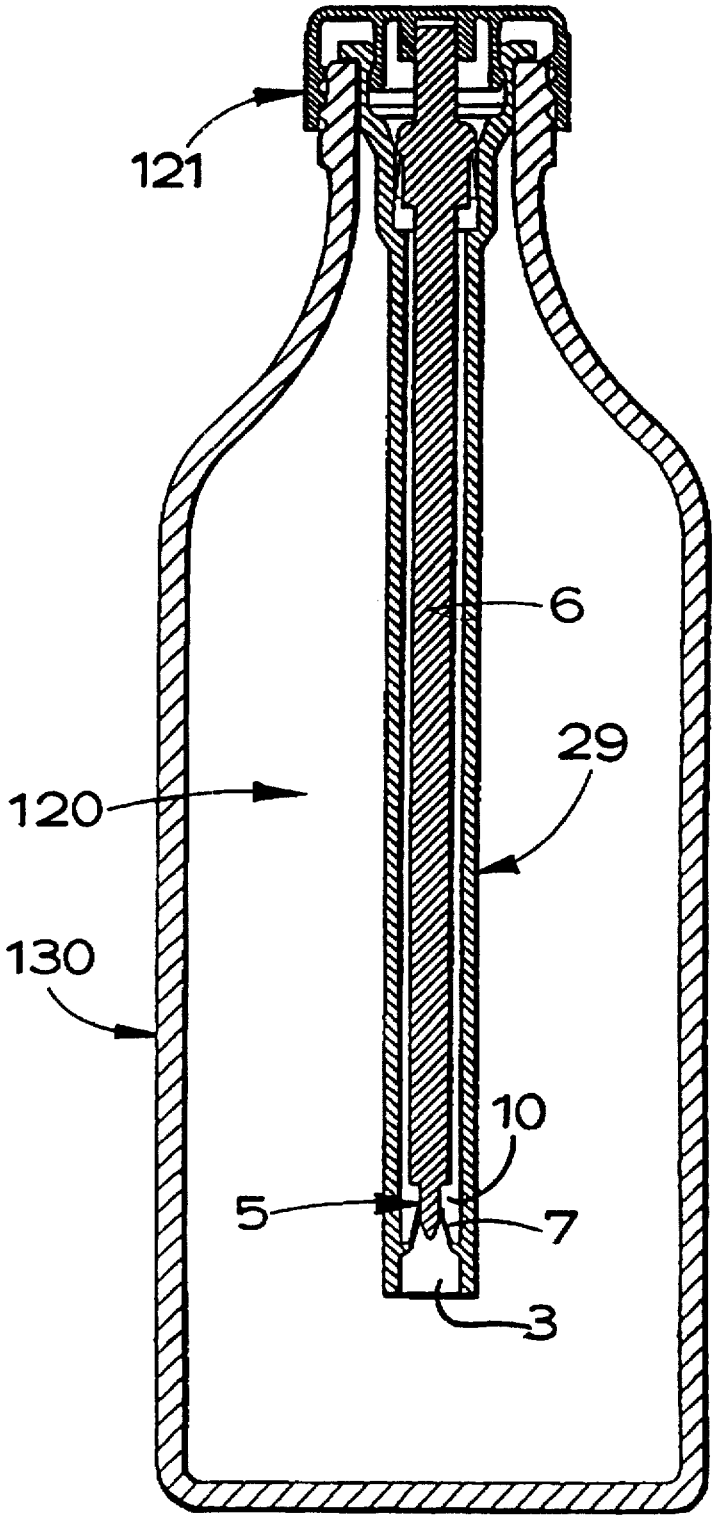

FIG. 2 is a vertical cross-section of the reservoir body of the reservoir unit of FIG. 1, FIG. 3 is a side elevation, partly in vertical cross-section, of a modified valve control and integral outlet valve for use with the body of FIG. 2, FIG. 4 is an enlargement of the lower end of the reservoir body of FIG. 2 showing the annular sealing lip of the outlet valve means, FIG. 5 is an enlargement of the upper end of the reservoir body of FIG. 2, FIG. 6 is a cross-section of the body on the line 6—6 of FIG. 5, FIG. 7 is an enlarged underplan view of the valve retainer of FIG. 1, FIG. 8 is a section on the line 8—8 of FIG. 7, FIG. 9 is an enlargement of FIG. 9, FIG. 10 is an underplan view of the integral outlet valve member and control rod of FIG. 9, FIG. 11 is an enlarged vertical cross-section of the gas reservoir of FIG. 1, FIG. 12 is a section similar to FIG. 11 but showing an outlet valve member of modified shape, FIG. 13 is a section similar to FIG. 11 showing a modified configuration of outlet valve employing a fixed restrictor, FIG. 14 is a vertical cross-section of the upper part of a bottle into which the charged gas reservoir unit of FIGS. 1, 3 has been inserted, and prior to application of the bottle top, FIG. 15 is a view similar to FIG. 14 but showing the cap fully screwed onto the bottle, so as to displace downwards the valve retainer, FIGS. 16 and 17 are views corresponding to FIGS. 14 and 15 showing a modified reservoir unit fitted to a bottle of different shape, FIGS. 18 and 19 are vertical cross-sections of a beverage can incorporating a gas reservoir unit which is a modification of the unit of FIG. 1, prior to application of a sealing plug in FIG. 18, and after application of a sealing plug in FIG. 19, FIG. 20 is a plan of the can of FIG. 19, FIG. 21 is a vertical cross-section of a multi-chambered gas reservoir unit, the annular chambers of which can be vented in turn through the outlet, FIG. 22 is a longitudinal cross-section of a gas reservoir unit housed in a beer keg, FIG. 23 is a vertical cross-section of a modified gas reservoir assembly for closing an opening in a bottle, and FIGS. 24 and 25 are vertical cross-sections of the assembly disposed in the neck Of the bottle so as to close it.

With reference to FIG. 1, a self-contained gas reservoir unit 1 comprises an elongate, tubular plastics body 2 having a gas outlet 3 at one end 4 thereof controlled by an outlet valve means 5 and a valve control rod 6, constituting a valve control means, extending to the other end of the reservoir body 2, which end is in the form of a basket 5' adapted to fit snugly within the neck 21 of a beverage container in the form of a bottle 22 (FIG. 14). The unit 1 and bottle 22 together form a beverage container assembly 28.

The outlet valve means 5 comprises a valve member in the form of a pin 9 which is slidable through an annular lip seal 7, shown most clearly in FIG. 11, the pin 9 being provided with an axially-extending groove 8 which provides a restricted bypass to the seal 7 when the pin 9 is raised sufficiently from the position shown in FIGS. 1 and 11 for the groove 8 to extend above the sealing lip 7. When this happens in use, bubbles of gas will be emitted from groove 8 into the beverage surrounding the lower part of the reservoir assembly 1.

The rod 6 is of cruciform section for most of its length to provide strength and yet not occupy an excessive volume in the gas reservoir chamber 10.

The lower end of the chamber 10 is sealed at the lower end by lip seal 7, as just described, and at the upper end by a flared portion 11 on the rod 6. Whereas in FIG. 1 the flared portion 11 is a solid frustum, in the modification of FIGS. 3 and 9 the flared portion 11 is a downwardly-directed flexible skirt.

A valve retainer 12, shown enlarged in FIGS. 7 and 8, is holding the valve means 5 closed in the condition of FIG. 1, the valve retainer 12 abutting an internal rib 17' at the upper end of the cylindrical internal wall 13 of the basket 5' on the one hand, and on the other hand gripping a head 14 at the upper extremity of the valve control rod 6. FIG. 1 shows the gas reservoir unit 1 in a gas charged condition, whereby the gas reservoir chamber 10 contains gas, for example carbon dioxide, at super-atmospheric pressure. In its charged condition the unit can be transported to a bottling plant for insertion into the bottle 22.

It will be appreciated that the valve retainer 12 is dimensioned such that the frictional grip exerted by the retainer is sufficient to withstand the net upward force exerted on the rod 6 by virtue of the pressure of gas in chamber 10 acting over the difference between the cross-sectional area of the bore of the main part of the reservoir body 2 and the cross-sectional area of the pin 9. As shown in FIGS. 7, 8, the retainer 12 is of spider form, comprising a hub 15 connected by three integral spokes 16 to a rim 17. Rim 17 is a sliding fit on the wall.

The hub 15 is a firm fit on the head 14 but the retainer 12 can be pushed downwards relative to basket 5 and rod 6, as shown in FIGS. 14 and 15, to bring hub 15 into registry with a reduced-diameter portion 18 of the upper end 19 of rod 6, to free rod 6 for subsequent upward movement relative to body 2. The upper end 19 of rod 6 is hollow to save material.

As shown in FIG. 14, basket cylindrical portion 20 is dimensioned to be a snug or force fit in the neck 21 of a beverage bottle 22, which may be of glass or plastics, an external annular lip 23 on the upper extremity of the basket engaging with the rim of the bottle neck to locate the gas reservoir in the bottle.

The fit of the portion 20 in the bottle neck results in the basket functioning as a plug to help to prevent the gas reservoir unit from being inadvertently expelled from the bottle under pressure.

Basket 5' comprises a ported frusto-conical basket base 24 connecting the cylindrical portion 20 to the main, tubular, portion of reservoir body 2, three apertures or ports 26 being defined between mutually inclined spokes 27, the ports 26 providing passages for beverage to flow out of the bottle during pouring.

The dimensions of spokes 27 and ports 26 can be chosen if desired to provide a significant restriction to the outflow of beverage to inhibit flow in the event that an open bottle is accidentally knocked over.

FIG. 14 shows the special form of bottle cap 30 which is employed to disable the valve retainer 12 on initial securing of the cap 30 onto the bottle 22. Cap 30 comprises a conventional metal cap body 34 but containing a plastics sealing ring 32 incorporating a pronounced downwardly-directed annular protrusion 31 which is dimensioned to engage with the retainer 12 on initial assembly of the cap 30 to the bottle 22. The retainer 12 is then pushed axially downwards to the position shown in FIG. 15, in which position the hub 15 is in registry with the upper part of the reduced-diameter portion 18 of valve control rod 6. Annular protrusion 31 constitutes a valve retainer disabling means.

It should be noted that the length of the head 14 of the rod 6 is such that in the condition of FIG. 15 in which the cap 30 is firmly secured on the bottle, for transit of the bottle to a retailer etc, the extremity of head 14 abuts the underside of the central part 36 of the cap washer 32 whereby the valve control rod 6 holds the valve pin 9 in a closed condition.

Thus, in securing the cap to the bottle the cap takes over from the valve retainer 12 in holding the valve control rod 6 in a valve-closed condition.

Since the axial length of reduced-diameter portion 18 is made less than the axial length of the hub 15 of the retainer, and since the retainer can slide on basket wall 13, on opening of the bottle preparatory to pouring out a drink, the removal of the cap 30 removes the downward axial restraint on rod end 14, thereby allowing the super-atmospheric pressure of gas in chamber 10 to urge rod 6 upwards, to open the reservoir outlet valve means S. Bubbles of gas are then emitted from slot 8 into the beverage.

When the beverage is carbonated beer, the bubbles of gas emitted from the reservoir 2 will seed the production of further bubbles of carbon dioxide from that dissolved in the beer. It may, however, be possible in the case of other carbonated beverages, such as colas, to utilise the gas in the gas reservoir as the main, or sole, agent for gasifying the beverage, thereby reducing or avoiding the need to gasify the beverage prior to or during bottling of the beverage.

FIGS. 12 and 13 show modified valve outlet means. In FIG. 12 the valve pin 9 is stepped, a smaller diameter portion 9' of the pin being connected to a larger diameter portion 9' by a sloping shoulder 9''', a radial clearance between the lip 7 and the portion 9' in the raised condition of rod 6 providing a restricted outlet from the gas reservoir 10. In the embodiment of FIG. 13 a plug 3' provides a fixed restrictor, and the valve means 5 comprises a cone valve member 5' on the rod 6.

With reference to FIGS. 16 and 17, the reservoir body 2 of this embodiment comprises a relatively deep basket as compared with the basket of the FIG. 1, 3 construction, but the method of operation is the same. The cap 30 is now of the 'Crown' (RTM) type rather than the screw type shown in FIG. 14.

With reference to FIGS. 18 to 20, these show the application of the invention to a beer can 57, such as a 440 ml can. The gas reservoir unit 1 is essentially of identical construction and functioning to that of FIG. 1, except that the upper rim of the basket cylindrical wall 20 is integrally connected to a reservoir mounting disc 50 through an internally-threaded sleeve 51 adapted to threadedly receive a closure plug 52.

The mounting disc 50 is seemed into the top seam 53 connecting the can side walls 54 with the annular can top 55.

Plug 52 has an internal downwardly-directed protrusion 31' which effects the same action on retainer 14 to that of protrusion 31 on the bottle cap of FIGS. 14, 15.

It will be appreciated that the construction of FIGS. 18, 19 provides a can which the user can re-seal by re-securing the plug 52 after partial emptying of the contents of the can.

The gas reservoir unit 1 can be stored in a pre-charged condition and, indeed, the can top wall 55 can be provided in position on the disc 50, for subsequent incorporation of the reservoir and top wall into a can, the seam 53 being produced in substantially conventional manner following filling of the can body.

FIG. 21 shows a modified gas reservoir unit 58 with a body 60 of multi-stepped form housing a multi-stepped valve control member 61 between which are defined a series of discrete gas reservoir chambers 62 to 67 which can be vented in turn through the valve means 5. This enables a carbonated beverage to be 're-charged' with gas several times, to enable a beverage container containing carbonated drink to be re-sealed after dispensing a drink, without the usual problem that the container contents have 'gone flat' when the container is next opened.

The outlet valve means 5 is similar to that employed by the unit 1 of FIG. 1. The body 60 is, however, formed with additional integral annular sealing lips 68 to 72 adjacent the respective steps 73 to 77 in the body 60, the sealing lips 68 to 72 sealing, in the condition shown, with the lower end of the respective upwardly-disposed piston portion 78 to 82, these portions being connected by frusto-conical piston portions 83 to 87.

The vertical positions of the lips 68 to 72 in relation to the vertical positions of the steps 73 to 77 is arranged as shown in FIG. 21 such that on initial upward displacement of the member 61 to open the valve means 5, only lower chamber 62 is connected to outlet 3, the sealing lips 68 remaining in contact with the piston portion 78. Thus the contents of chamber 62 can be vented into the beverage to gasify the beverage to enable a carbonated drink to be poured.

On further upward displacement of the ember 61, the frusto-conical portion 83 will enter the sealing lip 68 allowing chamber 63 to vent through chamber 62 and open valve means 5 into the beverage, lips 69 remaining in engagement with piston portion 78.

Similarly, as the member 61 is incrementally displaced upwards, the chambers 64, 65, 66 and 67 will be vented in turn.

Suitable finger-operable actuating means, comprising a screwable or indexable member, not shown, is provided externally of the container top to enable the user to vent the chambers 62 to 67 in turn.

FIG. 22 shows a beverage container assembly 88 comprising gas reservoir unit 90 mounted within a metal beer keg 91. The unit 90 comprises a steel or aluminum cylinder 92 closed at its lower end by a threaded plug 93 which is provided with an outlet port 94 leading from a conical valve seat 95 engageable by a frusto-conical outlet valve member 96 on the lower end of axial valve control rod 97. The upper end, in FIG. 22, of the cylinder 92 is secured to a housing 98 of inverted top-hat shape by a threaded engagement with a tubular spigot 99.

The control rod 97 carries a piston 100 at its upper end sealed to the internal wall of cylinder 92 by an annular seal 101, an axial bore, not shown, through piston 100 and in the upper end of rod 97 providing permanent fluid communication between a Schrader-type fill valve 102 and a transverse inlet port 103 in rod 97, the valve 102 enabling the reservoir chamber 104 to be charged with gas.

The chamber 104 can be charged with nitrogen or other suitable gas at super-atmospheric pressure prior to assembly of the gas reservoir unit 90 to the keg 91, or subsequent thereto.

A cap 105 with finger-engageable lugs 106 is threadedly engaged on the radially outer surface of the spigot 99 and is dimensioned such that when the cap is fully screwed down on spigot 99 an abutment at 107 between the cap 105 and a flange 103 on the control rod 97 holds the valve rod 97 downwards to hold closed the outlet valve means 95, 96. Thus chamber 104 is charged with gas at super-atmospheric pressure in this condition of the valve means 95, 96 after suitable purging of chamber 104.

When it is desired to open the valve means 95, 96 to allow gas under pressure to enter the beer in the keg, this is effected by unscrewing of the cap 105 by a predetermined amount, which allows the control rod 97 to rise relative to cylinder 92, under the pressure of gas acting on piston 100.

For safety reasons a circlip 109 is provided to retain the cap 105 captive to the housing 98, the circlip being located internally of the cap prior to assembly of the cap to the housing 98, but snapping into an external recess on spigot 99 as the cap reaches the fully-on position. Circlip 109 permits sufficient unscrewing of the cap on spigot 99 to enable the valve means 95, 96 to open, for example by about 1 mm (0.040 inch).

A further safety retention means is provided by a retaining clip 110 which is received in an internal recess of an annular protrusion Ill on the keg, and abuts with a flange 112 on housing 98.

Whilst the arrangement of FIG. 22 has been described in relation to the dispensing of beer from a beer keg, it will be appreciated that the gas reservoir unit 90 could be used for the dispensing of other liquids from containers, such as the dispensing of oil from an oil drum.

It will be appreciated that when the gas reservoir unit 90 of FIG. 22 is mounted in a keg or drum, there is no requirement for the user of the keg or drum to provide an external gas supply for driving the contents from the keg or drum. Accordingly no such connection has to be made by the user, and possible contamination of the contents of the keg or drum during connection of the gas supply is avoided. The keg or drum can be supplied containing the charged reservoir assembly, so that the user merely has to connect any outlet pipe work, and to release the cap 105.

With reference to FIGS. 23 to 25, FIG. 23 shows a self-contained, gas-charged gas reservoir combination 120, comprising a gas reservoir unit 129 with a container sealing member in the form of a bottle screw cap 121 attached thereto.

The gas reservoir unit 129 is basically of the form of the gas reservoir unit 1 of FIG. 1, having a tubular body 2 with a outlet 3 at lower end 4, outlet valve means 5, a valve control rod 6 and a ported basket end 5' adapted to fit snugly within the neck 122 (FIG. 24) of a container for beverage in the form of a bottle 130.

The valve member/pin 9 has an axially extending groove (not shown) corresponding to groove 8 of FIG. 1.

The cap 121 has a central, downwardly directed annular protrusion 123 defining an axial bore or recess 124 dimensioned to receive the upper or extended end 19 of the control rod 6. The diameter of the lower or open end of the bore 124 is slightly smaller than that of the remainder of the bore. The diameter of the upper end of the extension 19 is slightly greater than that of the remainder thereof. This arrangement provides an initial 'click-fit' between the extension 19 and the bore 124 when the cap 121 is fitted in place. The protrusion 123 is enclosed by a coaxially disposed skirt 125 which extends downwardly beyond the protrusion and into the inner wall 126 of the basket 5'. The inner wall 126 has an enlarged diameter portion 127 which receives an external lip 128 on the lower end of the skirt 125. The lip 128 provides an initial 'click-fit' between the cap 121 and the unit body 2.

The upper end 19 of the control rod 6 and the bore 124 of the cap 121 which receives it together form valve retainer means equivalent to valve retainer means 12 of FIG. 1.

Towards the upper end of the control rod 6 there is a flared portion 11 comprising a downwardly-directed flexible skirt. As mentioned above, portion 9 of the control rod 6 has a reduced-diameter portion, not shown, but equivalent to portion 18 of FIG. 9.

The cap 121 is provided with internal threads 129 which engage with external threads 135 formed on the neck 122 of the bottle 130.

In use, the charged gas reservoir assembly 120 is disposed within the bottle 130, said bottle being previously filled with beverage, and the cap 121 screwed down, as shown in FIG. 24. This causes relative movement between the bore 124 of the cap and the portion 19 of the control rod 6, whereby the portion 19 initially 'click-fits' into the bore 124 and thereafter substantially fills the bore, whereby a downward axial restraint on the control rod 6 is imposed.

With reference to FIG. 25, bottle-opening movement of the cap 121 removes the downwardly-acting axial restraint on the control rod 6. This allows the super-atmospheric pressure of gas in the chamber 10 to act against the underside of the flared portion 11 so as to urge it, together with the control rod 6, upwardly in order to open the outlet valve means 5, whereby gas escapes into the interior 136 of the bottle 130, by way of the above-mentioned axially-extending groove, formed in the pin 9.

Removal of the cap 121 results in removal of the gas reservoir unit 129 attached thereto. The beverage in the bottle 130 can then be consumed. Subsequently, the gas reservoir unit 129 and the cap 121 attached thereto (by 'click-fit' engagement between portion 19 and bore 124, and between lip 128 on the cap 121 and the unit body 2) an be disposed of, or recycled.

This modification of the invention can be used with container closures other than screw-threaded caps- For example, external screw stoppers or 'CROWN' (Registered Trade Mark) tops.

GB 2031/1892 discloses a 'CROWN' bottle top. GB 4184/1879 discloses an internal screw stopper.

Where possible, and where desirable, any of the features disclosed herein may be added to, or substituted for, each other. For example, the gas reservoir unit of FIG. 18 may be substituted for that illustrated by FIG. 1.

I claim:

1. A beverage container assembly comprising a container body defining a beverage chamber for containing a beverage, and a gas reservoir unit housed substantially within the container body, adapted to be charged with a gas under super-atmospheric pressure whilst the reservoir unit is outside of the container, and to retain the gas prior to insertion of the unit into the container body, characterised in that the unit has, in its normal position within the container body, a gas reservoir chamber with gas outlet means at the lower end thereof, said gas outlet means being adapted to be opened by valve control means during or subsequent to insertion of the unit into the container body, so as to allow gas in the gas reservoir chamber to issue into beverage present in the container body, the valve control means being movable upwardly away from the gas outlet means and into the gas reservoir chamber so as to allow gas to issue from the gas outlet means and into said beverage.

2. A beverage container assembly as claimed in claim 1, provided with a skirt structure which extends beneath the gas outlet means.

3. A beverage container assembly as claimed in claim 1, wherein in its normal position within the container body, the gas outlet means is submerged in beverage.

4. A beverage container assembly as claimed in claim 1, wherein the unit is of elongate form, the valve control means extending from said gas outlet means to substantially the other end of the unit and operable to open the gas outlet means by direct mechanical actuation imposed by movement of said valve control means.

5. A beverage container assembly as claimed in claim 4, wherein the gas reservoir unit is provided with a gas outlet controlled by valve means operable by actuating means accessible from the exterior of the container body.

6. A beverage container assembly as claimed in claim 1, provided with a valve retainer, adapted to retain the gas outlet means closed after gas-charging of the gas reservoir unit and prior to insertion of the reservoir unit into the container body, and valve retainer disabling means arranged to disable the valve retainer during sealing of the container.

7. A beverage container assembly as claimed in claim 6, formed and constructed so that the assembly of a sealing member to the container is arranged to disable a valve control means.

8. A beverage container assembly as claimed in claim 7, wherein the sealing member comprises a closure which displaces the valve retainer during securing of the closure (30) to the container, displacement of the valve retainer moving the retainer relative to the valve control means from a position in which the valve retainer holds the valve control means (6) in a valve-closed condition, to a position in which the valve retainer permits movement the valve control means to allow opening of the valve control means.

9. A beverage container assembly as claimed in claim 4, comprising a can containing beverage, wherein one end of the gas reservoir unit is positioned at a substantial depth of the beverage such that when gas is emitted through the gas outlet means into the beverage, the gas has to rise through a significant depth of the beverage, said other end being positioned at or adjacent the top of the can.

10. A beverage container assembly as claimed in claim 4, comprising a bottle containing beverage, wherein one end of the gas reservoir unit is positioned at a substantial depth of the beverage such that when gas is emitted through the gas outlet means into the beverage, the gas has to rise through a significant depth of the beverage, said other end being positioned at the neck of the bottle.

11. A beverage container assembly as claimed in claim 8, wherein said valve control means comprises a rod which carries an outlet valve member adjacent said one end of unit and co-operates with said valve retainer adjacent said other end of the unit.

12. A beverage container assembly as claimed in claim 11, wherein the valve retainer comprises a spider disposed in an axially outer position relative to the body of the reservoir unit, and arranged to hold said rod axially relative to the unit body, but in a displaced, axially inner position relative to the unit body permits axial movement of the rod so as to enable the valve to open.

13. A beverage container assembly as claimed in claim 11, wherein the valve retainer is disabled by an axially projecting annulus on the container sealing member, which annulus displaces the spider from said outer position to said inner position on securing the sealing member to the container.

14. A beverage container assembly as claimed in claim 1, wherein the upper end portion of the reservoir unit body is in the configuration of an aperture basket, to enable beverage to flow out of the container aperture that is sealed by the sealing member.

15. A beverage container assembly as claimed in claim 14, wherein the apertures in the basket are dimensioned to restrict the flow such that if the opened container is hocked over the spillage is significantly less than if the basket were not in place.

16. A beverage container assembly as claimed in claim 1, wherein the gas reservoir unit is provided with two or more gas chambers for containing gas under super-atmospheric pressure and gas outlet means adapted to connect the gas chambers in turn to be emitted into beverage in the container.

17. A beverage container assembly as claimed in claim 16, wherein the gas chambers comprise annular chambers defined between a multi-stepped valve control member and the wall of a multi-stepped bore of the gas reservoir body in which the member is axially movable.

18. A beverage container assembly as claimed in claim 17, wherein each annular chamber is sealed adjacent one axial end thereof, that end towards the smallest end of the stepped bore, by an annular sealing means acting between the valve control member and the bore wall, the arrangement being such that on a predetermined axial displacement of the member in the bare from an initial position in which the chambers are sealed from one another, the sealing means at said one end of the chamber becomes inoperative, thereby allowing fluid communication between said annular chamber and the respectively adjacent smaller diameter portion of bore, and the relative axial dispositions of the sealing means being arranged such that as valve control member is displaced progressively in the direction towards the larger diameter end of the multi-stepped bores, the respective sealing means become inoperative in turn, to connect the respective chamber with an outlet leading from the smallest end of the stepped bore.

19. A beverage container assembly as claimed in claim 17 wherein each annular chamber is sealed adjacent one axial end thereof, that end towards the smallest end of the stepped bare, by an annular sealing means acting between the valve control member and the bore wall, the arrangement being such that on a predetermined axial displacement of the member in the bore from an initial position in which the chambers are sealed from one another, the sealing means at said one end of the chamber becomes by-passed, thereby allowing fluid communication between said annular chamber and the respectively adjacent smaller diameter portion of the bore, and the relative axial dispositions of the sealing means being arranged such that as the valve control member is displaced progressively in the direction towards the larger diameter end of the multi-stepped bores, the respective sealing means become by-passed in turn to connect the respective chamber with an outlet leading from the smallest end of the stepped bore.

20. A beverage container assembly as claimed in claim 19, wherein the sealing means comprise respective annular sealing lips depending integrally from the bore wall, the valve control member being provided with a respective frusto-conical section between respectively adjacent portions of larger and smaller diameter, the sealing means being bypassed when the member has moved sufficiently to bring the respective frusto-conical portion substantially into register with the respective sealing lip.

21. A beverage container assembly as claimed in claim 19, wherein the axial movement of the valve control member is controlled by a finger-operable actuating means which is calibrated to enable the gas in the chambers to be released one at a time from the reservoir unit by operation of the actuating means.

22. A beverage container assembly as claimed in claim 21, wherein the actuating means comprise a rotary member which can be turned or indexed by the user of the unit.

23. A beverage container assembly as claimed in claim 1, wherein the container comprises a bottle and the gas reservoir unit comprises a reservoir securing means which is adapted to be secured to the bottle neck to retain the gas reservoir unit in position in the bottle.

24. A beverage container assembly as claimed in claim 23, wherein the securing means substantially prevents the gas reservoir unit from being ejected under pressure from the bottle.

25. A beverage container assembly as claimed in claim 24, wherein the reservoir securing means is in the form of a plug fitted in the bottle neck, the plug being provided with pouring apertures to permit beverage to be poured from the bottle.

26. A beverage container assembly as claimed in claim 25 wherein the plug is in the form of an apertured basket.

27. A beverage container assembly as claimed in claim 1, provided with container sealing member in the form of a container closure cap.

28. A beverage container assembly as claimed in claim 27, wherein the container comprises a bottle and the closure cap is provided with an internal screw thread engageable with an external screw thread formed on the neck of the bottle.

29. A beverage container assembly as claimed in claim 27, wherein the container comprises a bottle and the closure cap comprises a crown type bottle top.

30. A beverage container assembly as claimed in claim 1, wherein the container comprises a bottle and the assembly is provided with a container sealing member comprising a bottle stopper insertable in the neck of the bottle.

31. A beverage container assembly as claimed in claim 1, wherein the container body is a beer keg.

32. A beverage container assembly comprising a container body defining a beverage chamber for containing a beverage, and a gas reservoir unit housed substantially within the container body, charged with a gas under super-atmospheric pressure whilst the reservoir unit is outside of the container, and to retain the gas prior to insertion of the unit into the container body, characterised in that the unit is of elongate form with gas outlet means positioned substantially at one end of the unit said gas outlet means being adapted to be opened by a valve control means during or subsequent to insertion of the unit into the container body, to allow gas in the reservoir to issue into beverage in the beverage chamber the valve control means also being of elongate form and extending longitudinally within the gas reservoir chamber and operable to open the gas outlet means by axial movement of said elongate valve control means within said chamber.

* * * * *